US005309936A

United States Patent [19]

Christensen

[11] Patent Number: 5,309,936

[45] Date of Patent: May 10, 1994

[54] POPPET CONFIGURATION FOR COUNTERBALANCE VALVE

[75] Inventor: Norman B. Christensen, Sarasota, Fla.

[73] Assignee: Dana Corporation, Toledo, Ohio

[21] Appl. No.: 55,029

[22] Filed: Apr. 30, 1993

[51] Int. Cl.[5] ..... F15B 13/04

[52] U.S. Cl. ..... 137/106; 91/420; 91/447

[58] Field of Search ..... 91/420, 447; 137/106

[56] References Cited

U.S. PATENT DOCUMENTS

| | | | |
|---|---|---|---|
| 2,648,346 | 8/1953 | Deardorff et al. . | |
| 3,274,902 | 9/1966 | Kleckner . | |
| 3,587,399 | 6/1971 | Parquet | 91/420 |
| 3,595,264 | 7/1971 | Martin | 91/420 X |
| 3,792,715 | 2/1974 | Parrett et al. | 137/493 |
| 4,058,135 | 11/1977 | Petro . | |
| 4,172,582 | 10/1979 | Bobnar | 91/420 X |
| 4,336,826 | 6/1982 | Grawunde | 91/420 X |
| 4,466,336 | 8/1984 | Broome et al. | 91/420 |
| 4,633,762 | 1/1987 | Tardy . | |

FOREIGN PATENT DOCUMENTS

| | | | |
|---|---|---|---|
| 59-113378 | 6/1984 | Japan | 91/420 |

*Primary Examiner*—Gerald A. Michalsky
*Attorney, Agent, or Firm*—Millen, White, Zelano & Branigan

[57] ABSTRACT

A counterbalance valve has a first port connected to a hydraulic cylinder and a second port connected to a four-way controller, such as a four-way control valve. Disposed between the ports is a poppet biased to a closed position. The poppet opens to allow operating hydraulic fluid to drain from the hydraulic cylinder and also opens if excessive pressure builds up in the hydraulic cylinder due to thermal conditions. When an operator decides to move the piston within the hydraulic cylinder, hydraulic fluid must be drained from the cylinder. This is accomplished by moving the poppet from a blocking position to an open position with pressurized pilot fluid. On occasion, confusion caused by operator error can cause a build-up of valve backpressure from the four-way control valve, which prevents the poppet from moving upon applying pilot pressure thereto. The resulting excess pressure in the hydraulic cylinder can rupture the hydraulic cylinder. In order to minimize the chances of a rupture, the poppet is provided with a longitudinal bore extending therethrough. The bore allows backpressure from the four-way controller to be passed through the poppet so as to be applied to both ends of the poppet. Consequently, increases in valve backpressure have a corresponding increase in the relief setting. This minimizes a multiplier effect which could occur upon attempting to advance a piston while the four-way controller is inadvertently in a retracted mode.

13 Claims, 4 Drawing Sheets

POPPET CONFIGURATION FOR COUNTERBALANCE VALVE

FIELD OF THE INVENTION

The invention relates to counterbalance valves for use with hydraulic cylinders. More particularly, the invention relates to counterbalance valves having poppets to relieve overpressure in hydraulic cylinders.

BACKGROUND OF THE INVENTION

Counterbalance valves are used to hold hydraulic fluid in hydraulic cylinders so that pistons within the cylinders retain their position without drifting. Counterbalance valves may be made in various sizes and ratios, with various numbers of ports, and can be configured as single or double valves. They are necessary when used with four-way controls because four-way controls utilize spool valves, which have leakage that tends to allow drifting. Counterbalance valves are constructed to minimize leakage and are mounted either close to or on an associated hydraulic cylinder so that if a hydraulic line breaks, the cylinder will not collapse so as, for example, to drop a load if it is associated with a lift, boom, or manned basket. Counterbalance valves include a self-relieving feature so that excessive pressure build-up in the associated hydraulic cylinder is relieved at a set pressure, allowing a portion of the hydraulic fluid to flow from the cylinder port through the counterbalance valve to a valve port.

On machines such as slag breaking machines used in steel mills and the like, the operator has a multiplicity of switches to manipulate. At times, the operator must manipulate these switches with gloved hands. Sooner or later, the operator will inadvertently combine the wrong set of circumstances with improper switch positions and cause rapid escalation of hydraulic pressure within the cylinder. For example, the rod end of a tool cylinder in a machine, such as slag breaking machine, may be inadvertently pressurized by motion from an incompatible function, such as an improper telescoping, propelling, or hoisting function. Normally, the counterbalance valve relieves pressure to accommodate such anomalies; but, for example, if the operator inadvertently operates a retract switch for the tool cylinder while the cylinder is being mechanically pulled out by an external force, such as propelling with the tool wedged in the slag, the cylinder can rupture due to rapid pressure escalation. A double counterbalancing valve may have a poppet set to relieve at 3800 psi with a 6:1 ratio, but, because of the geometry and areas of the counterbalance valve, a 6:1 ratio valve setting can have a 7:1 multiplier effect on the relief setting. This can cause the pressure within the valve to soar to 20,000 psi. Since cylinder failure can occur at 8000–10,000 psi, expensive cylinder failures can periodically occur.

SUMMARY OF THE INVENTION

It is a feature of the present invention to provide an improvement in counterbalance valves which compensates for backpressure erroneously introduced from a hydraulic control unit.

In view of this feature and other features, the present invention provides a passage through or around a spring-biased poppet used in a counterbalance valve, wherein the passage transmits hydraulic operating fluid from one end of the poppet to the other to compensate for erroneous, unintended increases in operating fluid pressure against the poppet which might interfere with the pressure relief function of the poppet.

In accordance with a preferred embodiment of the invention, the passage is configured as a bore through the poppet and includes an internal valve. The valve blocks the bore when pilot pressure is applied to the poppet and allows hydraulic operating fluid to flow through the bore to the pilot side of the poppet when there is backpressure holding the poppet in a blocking position.

DETAILED DESCRIPTION

FIGS. 1–4: The Counterbalancing Valve Structure

Figure 1:
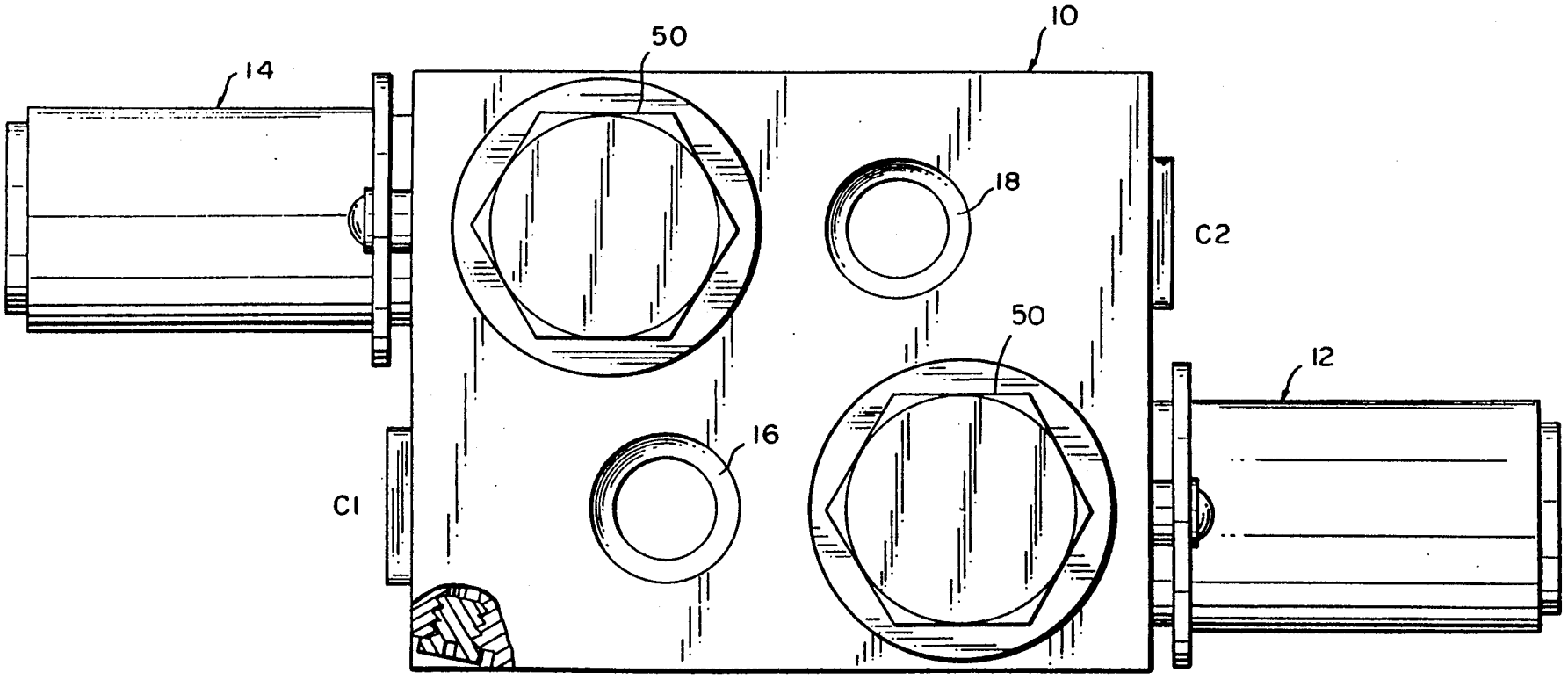
FIG. 1 is a top view of a double counterbalancing valve with which the principles of the present invention are utilized.
Figure 2:
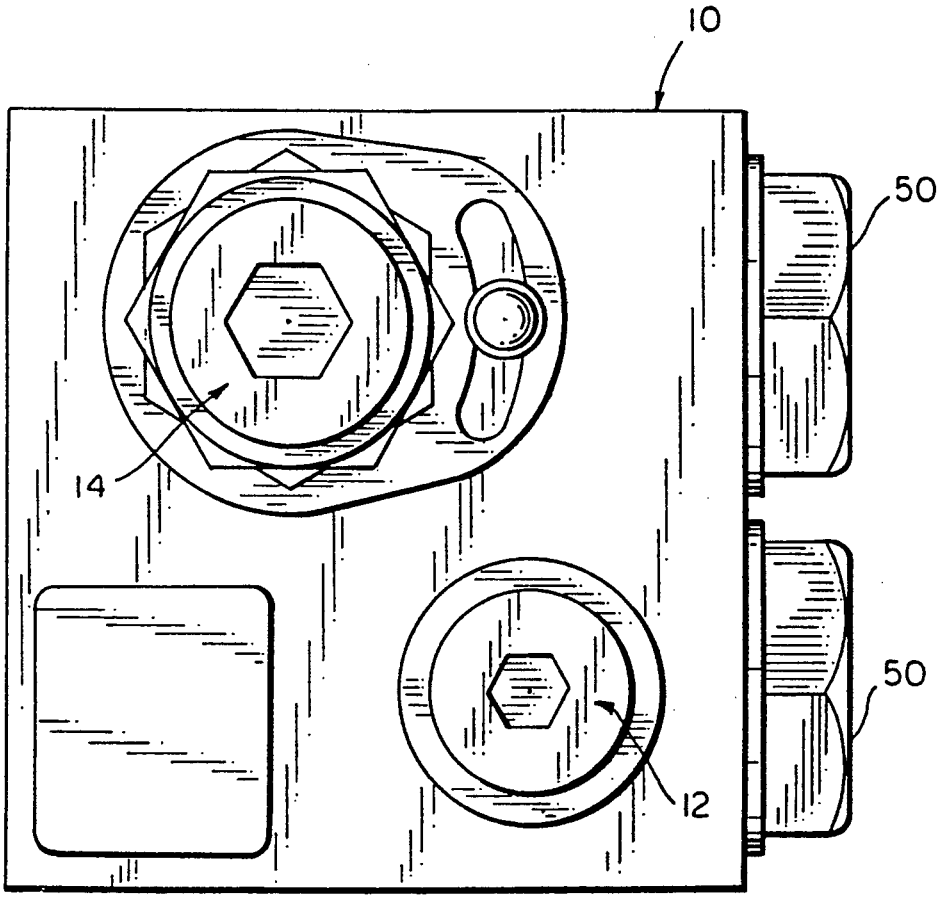
FIG. 2 is a side view of the double counterbalancing valve of FIG. 1.

Referring now to FIGS. 1 and 2, a double counterbalancing valve 10 is shown. The double counterbalancing valve includes a first counterbalance valve 12 and a second counterbalance valve 14, the first and second counterbalance valves being arranged as mirror images of one another. The double counterbalancing valve 10 includes a pair of first cylinder ports 16 and 18 for connection to a hydraulic cylinder associated with the single counterbalance valves 12 and 14, respectively.

Figure 3:
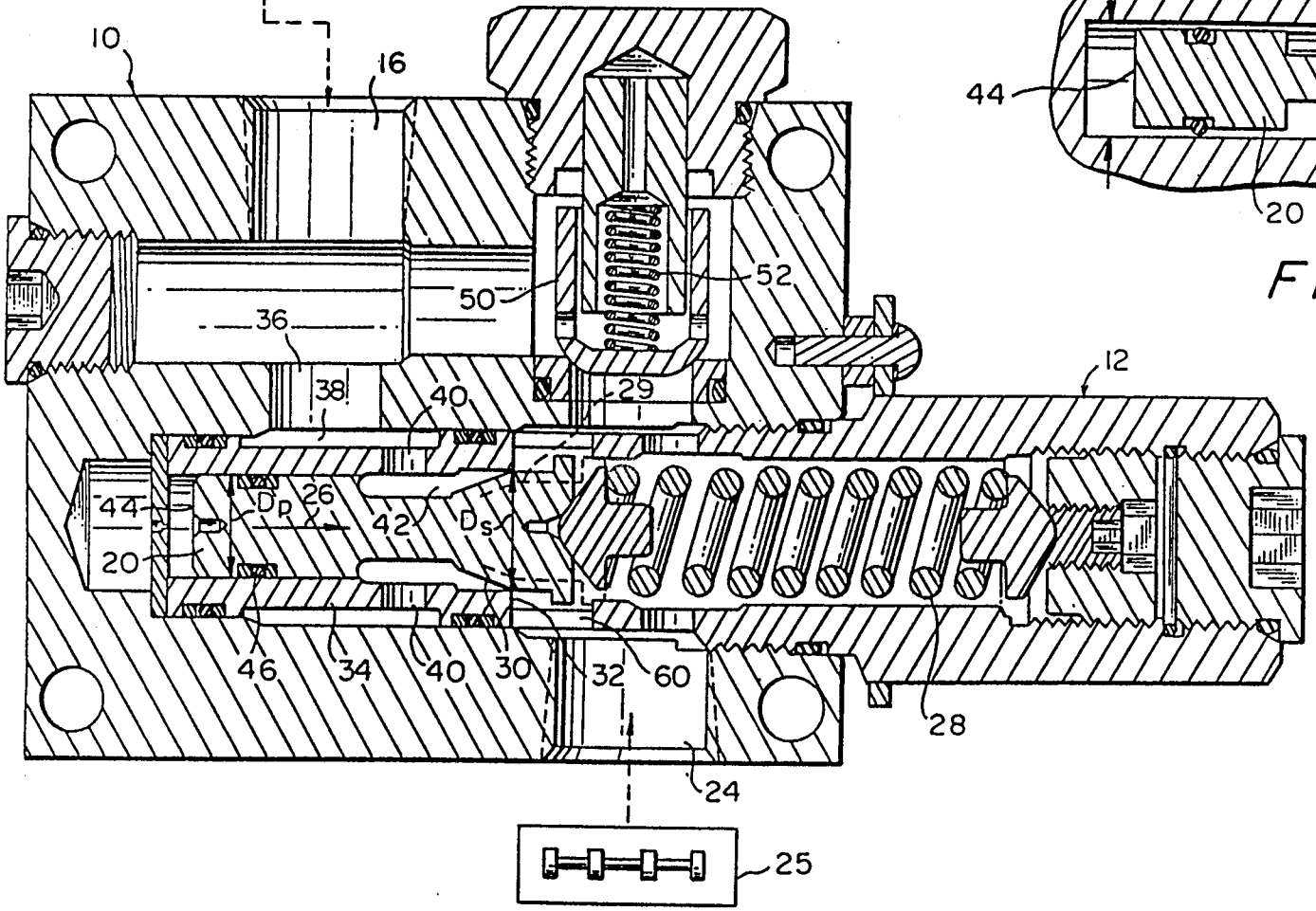
FIG. 3 (PRIOR ART)
FIG. 3 is a side elevation of the double counterbalancing valve of FIG. 1, configured in accordance with prior art technology.

In FIG. 3, a portion of the double counterbalancing valve 10 is shown in elevation, displaying the structure of the counterbalance valve 12. The single counterbalance valve 14 is identical in configuration to the single counterbalance valve 12, but, since the single counterbalance valves 12, 14 operate in an identical fashion, only the single counterbalance valve 12 is shown. The counterbalance valve 12 is disposed between the first valve port 16, which is connected directly to a port of hydraulic cylinder 22 having a piston 23, and a second or control port 24, which is connected to a four-way, spool-type controller 25. The controller 25 allows hydraulic fluid to flow out of the hydraulic cylinder 22 through the first or cylinder port 16 of the counterbalance valve 12 and out of the second or control port 24. Normally, reverse flow of hydraulic operating fluid is allowed to pass through the valve 10, and specifically through the single counterbalance valve 12, by moving a poppet valve 20 in the direction of arrow 26 against the bias of a coiled spring 28. The motion of the poppet 20 in the direction of the arrow 26 causes a gap 29 between a conical valve surface 30 and a valve seat 32 formed at the end of a sleeve 34, which slidably retains the poppet 20. Hydraulic operating fluid then flows to the gap 29 by flowing through a port 36 into a chamber 38, around the sleeve 34 and through openings 40 in the sleeve to an annular chamber 42 disposed between the outer surface of the poppet 20 and the inner surface of the sleeve, which annular chamber communicates with gap 29.

The poppet 20 has a first or pilot end 44 against which pilot fluid is applied to move the poppet in the direction of arrow 26 when it is desired to drain hydraulic fluid from the cylinder 22 to allow retraction of the piston 23. The valve seat 32 has a diameter $D_s$ which, as will be explained further hereinafter, determines the ratio of the valve setting when compared to the diameter $D_p$ of the pilot end 44 of the poppet 20.

When there is excessive hydraulic operating fluid pressure in the hydraulic cylinder 22, the pressure exerts a force against the differential area of the valve seat 32 for the conical valve surface 30 and the seal 46 and causes the poppet 20 to move in the direction of arrow 26 against the compression of the spring 28 without the application of pilot pressure. This provides a pressure-relief function. The pressure relief is set at a selected pressure of, for example, about 3800 psi, depending on the intended use of the counterbalance valve 10.

The counterbalance valve 10 includes a check valve 50, which is held closed by a spring 52, as well as by hydraulic operating fluid pressure from the hydraulic cylinder 22 applied through the inlet port 16. When the four-way control valve 25 causes a build-up of hydraulic pressure through the port 24 to extend the piston 23 in the cylinder 22, the check valve 50 opens against the bias of spring 52 to allow flow of hydraulic fluid through the port 16. Hydraulic pressure in the hydraulic cylinder 22, and thus the pressure applied through the inlet port 16, may for some reason be high when there is backpressure in the port 24 applied against a second end 60 of the poppet 20. When this backpressure force is added to the spring force of coiled spring 28, the relief function of the poppet 20 is, for all practical purposes, eliminated, allowing excessive pressure to rapidly build in the hydraulic cylinder 22.

Figure 4:
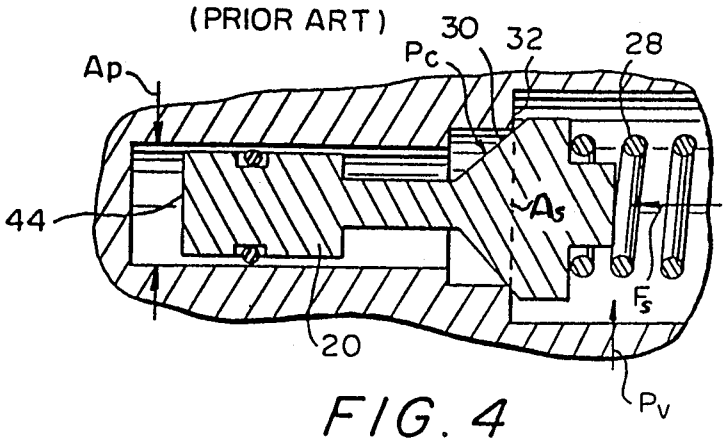
FIG. 4 is a side elevation of a poppet and associated structure shown in FIG. 3, illustrating a basis for determining valve and multiplier effect ratios.

Referring now to FIG. 4, there is an illustration of the poppet 20 and associated structures, such as the poppet spring 28, conical surface 30, valve seat 32, and poppet end face 44, to which the following parameters and relationships apply:

R:valve setting ratio;

$A_s$:area enclosed by seat 32;

$A_p$:area of pilot face 32;

$F_s$:force of spring;

$P_{th}$:thermally generated hydraulic pressure due to external heat, such as sunlight, on hydraulic cylinder 22;

$P_c$:hydraulic pressure from cylinder 22; and $P_v$:hydraulic backpressure from four-way controller 25.

In determining ratios such as the 6:1 relief valve ratio and the 7:1 multiplier effect, the following mathematical relationships apply:

| | |
|---|---|
| Ratio | $R = \frac{Ap}{As - Ap}$ |
| Solving for As | $As = Ap \times \left(\frac{1 + R}{R}\right)$ |
| Thermal relief setting | $F_s = P_{th} \times (As - Ap)$ |
| Balance of forces on spool with no pilot pressure | $Pc \times (As - Ap) = Fs + Pv \times As$ |
| | $Pc = \frac{Fs}{(As - Ap)} + Pv \times \frac{As}{As - Ap}$ |
| | Use Formula 3 for As |

-continued

| | |
|---|---|
| | $Pc = P_{th} + Pv \times \frac{Ap \times \left(\frac{1 + R}{R}\right)}{As - Ap}$ |
| | Use Formula 2 for As |
| | $Pc = P_{th} + Pv \times R \times \left(\frac{1 + R}{R}\right)$ |
| | Substitute Formula 1 |
| Simplify | $Pc = P_{th} + Pv \times [1 + R]$ |
| or Cylinder Pressure = | Thermal PS/setting + pressure in spring chamber × (ratio + 1) |

When the poppet 20 is functioning as a relief valve, the pressure in the cylinder 22 must overcome the spring 28 by working on the small differential area provided by the conical surface 30 on the poppet. With no pressure on the pilot side 44 of the poppet 20, the pressure entering through port 24 works on the full valve seat diameter $D_5$, which is, in effect, seven times the differential area in a 6:1 ratio valve. For every psi in the chamber 29 holding the spring 28, the cylinder pressure must increase seven times. The 6:1 ratio is exemplary of one valve ratio. Other ratios may be used for other applications. Regardless of the selected valve ratio, there will be a multiplier effect with the valve structure of FIGS. 3 and 4.

Figure 5:
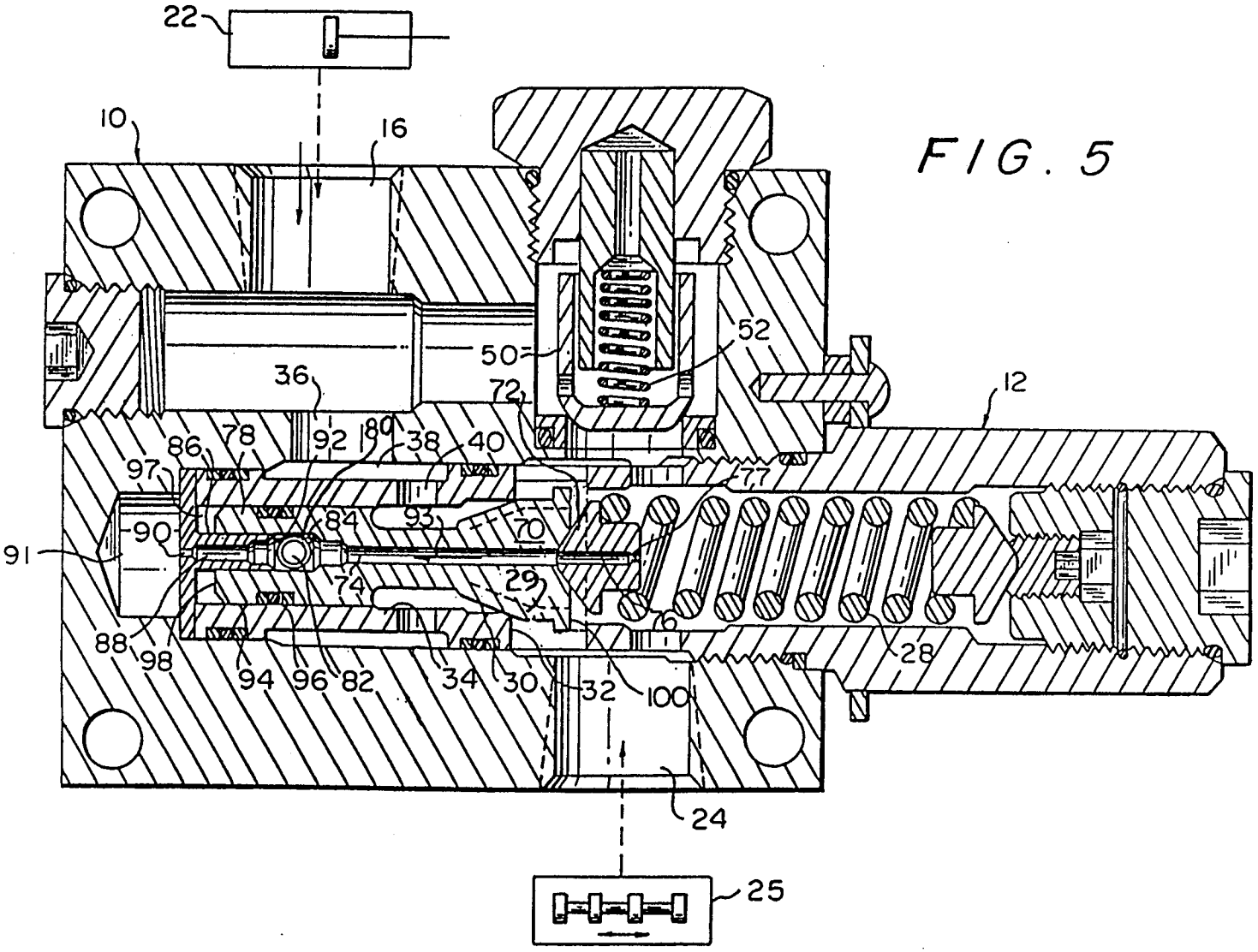
FIG. 5 is a side elevation of the double counterbalancing valve taken along lines 5—5 of FIG. 1, showing the valve with the improvements of the instant invention.

FIG. 5: The Improvement to the Counterbalance Valve Structure

Referring now to FIG. 5, there is shown an arrangement for solving the problems of the prior art configuration of FIG. 3. In FIG. 5, the inlet port 16 of the single counterbalance valve 12 is shown connected to a hydraulic cylinder 22, and the outlet port 24 is shown connected to a four-way controller 25 in the identical fashion of the prior art arrangement of FIG. 3. The control valve 12 of FIG. 5, however, includes a poppet 70 and a spring end 72, which have been modified to include central bores. The poppet 70 has a central bore 74 extending all the way therethrough, and the spring end 72 includes a fluid passage in the form of a central bore 76 with a small diameter bore section 77. Proximate a front end 78 of the central bore 74 of the poppet 70 is a valve chamber 80, which contains a ball valve 82. The ball valve 82 can seat against a valve seat 84, blocking the bore 74.

Received within the valve chamber 80 is a hollow stem 86, which has a relatively large diameter bore 88 and a relatively small diameter bore 90 therethrough, which small diameter bore is connected to a pilot oil chamber 91. The hollow stem 86 has a valve seat 92 therein against which the ball valve 82 seats when fluid pressure is in the direction of arrow 93, as will be explained further hereinafter.

When it is desired to open the single counterbalance valve 12, pilot pressure is applied to the pilot oil chamber 91, and pilot oil flows through bores 90 and 88 into the chamber 80. This rolls the ball valve 82 back against the seat 84, thus sealing the bore 74. The hollow stem 86 does not fit tightly within the chamber 80 so that the pilot oil flows between the stem and the inside cylindrical surface 94 of the poppet 70 within which the stem is slidably received. The pilot oil is prevented from flowing past the cylindrical end 95 of the poppet 70 by O-ring 96.

The poppet 70 has a pilot pressure face 98, which might have a pressure face area $A_p$ which is six times the difference between the seat area $A_s$ minus the pressure face area $A_p$, resulting in a valve ratio substantially greater than 1:1, for example, a ratio of 6:1.

Without employing the concepts of the present invention, the same phenomenon explained with respect to FIG. 4 would occur with respect to the poppet 70 of FIG. 5, wherein a multiplier effect of 7:1 would occur with a 6:1 valve setting. In order to avoid this phenomenon, which occurs when there is backpressure due to improper positioning of the four-way control valve 25, the bores 77 and 76 in the spring end and the bore 74 in the poppet 70 allow the backpressure to pass through the poppet 70. Valve pressure is thus applied to both ends 98 and 100 of the poppet 70, negating any force on the poppet due to valve backpressure.

Since there is a 1:1 ratio on the valve setting, there is a 1 psi increase to the relief setting for every 1 psi of valve pressure. This is far preferable to having a 7:1 multiplier effect.

The valve backpressure is equalized because hydraulic fluid flowing through the bores 78, 76, and 74 displaces the ball 82 from the seat 84 and flows into the chamber 80. The fluid then flows into the space 97 and applies force against the pilot pressure face 98, which provides a countervailing force to the force applied at the second end 100 of the poppet 70 by the backpressure. In effect, the excessive valve pressure counteracts itself so as to increase the relief setting with an increase in valve pressure.

The entire disclosures of all applications, patents, and publications, cited above and below, are hereby incorporated by reference.

From the foregoing description, one skilled in the art can easily ascertain the essential characteristics of this invention and, without departing from the spirit and scope thereof, can make various changes and modifications of the invention to adapt it to various usages and conditions.

I claim:

1. In a counterbalance valve assembly having at least one counterbalance valve, wherein the counterbalance valve is disposed between a first port for connecting the counterbalance valve to a hydraulic cylinder and a second port for connecting the counterbalance valve to a controller; wherein a poppet is disposed in the counterbalance valve, the poppet having a pilot pressure surface at a first end, a second end to which a spring force is applied, and a valve face engaged by a valve seat; wherein a spring biases the poppet to a blocking position preventing hydraulic operating fluid from flowing from the first port to the second port via a gap between the valve face and valve seat, the spring setting a relief pressure which allows the poppet to open when pressure applied to the valve face exceeds the pressure applied by the spring; the counterbalance valve further including a pilot hydraulic fluid chamber proximate the first end of the poppet for applying pilot hydraulic fluid pressure thereto in order to move the poppet against the bias of the spring when it is desired to open the valve, the improvement comprising:

a bore through the poppet, the bore allowing pressurized hydraulic fluid to flow from the second end of the poppet to the first end of the poppet, the bore having an internal valve for preventing pilot hydraulic fluid from passing from the first end of the poppet through the second end of the poppet, the bore further including means for allowing hydraulic operating fluid to flow past the internal valve when flowing from the second end of the poppet to the first end of the poppet so as to apply hydraulic operating fluid pressure at both ends of the poppet when hydraulic operating fluid pressure on the second end of the poppet exceeds a selected level.

2. The improvement of claim 7, wherein the internal valve comprises a chamber with first and second valve seats at opposite ends thereof and a ball within the chamber, wherein pilot pressure from pressurized pilot hydraulic fluid closes the bore by forcing the ball against the first seat while backpressure from hydraulic operating fluid forces the ball against the second seat, allowing the hydraulic operating fluid to flow from the second surface of the poppet through to the first surface of the poppet.

3. The improvement of claim 2, wherein there is a spring end fitting having a bore therethrough urged against the second end of the poppet, the bore in the spring end fitting being aligned with the bore in the poppet, whereby hydraulic operating fluid flows through the spring end fitting into the bore of the poppet.

4. The improvement of claim 3, wherein the bore through the spring end fitting has a narrow diameter portion where hydraulic operating fluid flows into the bore through the spring end fitting and a relatively large diameter portion which communicates directly with the bore through the poppet.

5. The improvement of claim 4, wherein the valve face of the poppet is conical, and the valve seat is circular.

6. The improvement of claim 5, wherein the pilot pressure surface has a first selected area, and the valve seat defines a second selected area larger than the first selected area, whereby the ratio of the first selected area divided by the difference in area between the second area and the first area provides a ratio of the valve which is a substantial multiple of 1.

7. The improvement of claim 6, wherein the ratio results in a multiplier effect, which multiplier effect is compensated for by the bore through the poppet.

8. The improvement of claim 1, wherein the valve face of the poppet is conical, and the valve seat is circular.

9. The improvement of claim 8, wherein the pilot pressure surface has a first selected area, and the valve seat defines a second selected area larger than the first selected area, whereby the ratio of the first selected area divided by the difference in area between the second area and the first area provides a ratio of the valve which is a substantial multiple of 1.

10. The improvement of claim 9, wherein the ratio results in a multiplier effect, which multiplier effect is compensated for by the bore through the poppet.

11. A poppet for use in a counterbalancing valve arrangement, wherein the counterbalancing valve arrangement has a pilot fluid chamber, first and second ports for passage of hydraulic operating fluid, and a valve seat and wherein the poppet is biased by a spring to block passage of hydraulic operating fluid from the first to the second port, the poppet comprising:

a first end in communication with the pilot hydraulic fluid chamber for movement to open the counterbalancing valve upon application of hydraulic fluid to the first end of the poppet, a second end of the poppet in fluid communication with the second port and in abutment with the spring, a valve face urged into abutment with the valve seat of the counterbalancing valve arrangement by the spring, and a bore through the poppet connecting the first end of the poppet to the second end of the poppet, the bore including a valve therein for preventing pilot fluid from flowing from the first end of the poppet to the second end of the poppet when pressure is applied to the pilot fluid, the valve including means for allowing backpressure in hydraulic operating fluid at the second port and applied against the second end of the poppet to flow through to the first end of the poppet wherein the poppet still relieves pressure at the first port, regardless of backpressure at the second port.

12. The poppet of claim 11, wherein the valve comprises a ball and a pair of opposed valve seats against one of which the ball is urged when pilot pressure is applied to the first end of the poppet.

13. The poppet of claim 11, wherein the valve face on the poppet is conical and wherein the valve seat is circular.

* * * * *